US006658890B1

(12) United States Patent
Hahn et al.

(10) Patent No.: US 6,658,890 B1
(45) Date of Patent: Dec. 9, 2003

(54) ENHANCED METHANE FLASH SYSTEM FOR NATURAL GAS LIQUEFACTION

(75) Inventors: Paul R. Hahn, Houston, TX (US); Jame Yao, Sugar Land, TX (US); Rong-Jwyn Lee, Sugar Land, TX (US); Ned P. Baudat, Sugar Land, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 10/294,112

(22) Filed: Nov. 13, 2002

(51) Int. Cl.[7] ..... F25J 1/00

(52) U.S. Cl. ..... 62/611; 62/613

(58) Field of Search ..... 62/611, 613, 612

(56) References Cited

U.S. PATENT DOCUMENTS

| | | | | | |
|---|---|---|---|---|---|
| 3,413,817 | A | * | 12/1968 | Kniel | 62/613 |
| 3,433,026 | A | * | 3/1969 | Swearingen | 62/613 |
| 3,531,942 | A | * | 10/1970 | La Fleur | 62/613 |
| 4,638,638 | A | * | 1/1987 | Marshall et al. | 62/613 |
| 4,758,257 | A | * | 7/1988 | Gates et al. | 62/613 |
| 5,537,827 | A | * | 7/1996 | Low et al. | 62/613 |
| 6,016,665 | A | | 1/2000 | Cole et al. | |
| 6,158,240 | A | * | 12/2000 | Low et al. | 62/611 |
| 6,289,692 | B1 | * | 9/2001 | Houser et al. | 62/613 |

* cited by examiner

*Primary Examiner*—William C. Doerrler
(74) *Attorney, Agent, or Firm*—Gary L. Haag

(57) ABSTRACT

Natural gas liquefaction system employing an open methane cycle wherein the liquefied natural gas is flashed immediately upstream of the liquefied natural gas storage tank and boil off vapors from the tank are returned to the open methane cycle.

39 Claims, 2 Drawing Sheets

ENHANCED METHANE FLASH SYSTEM FOR NATURAL GAS LIQUEFACTION

BACKGROUND OF THE INVENTION

1. Field of the Invention

Figure 1:
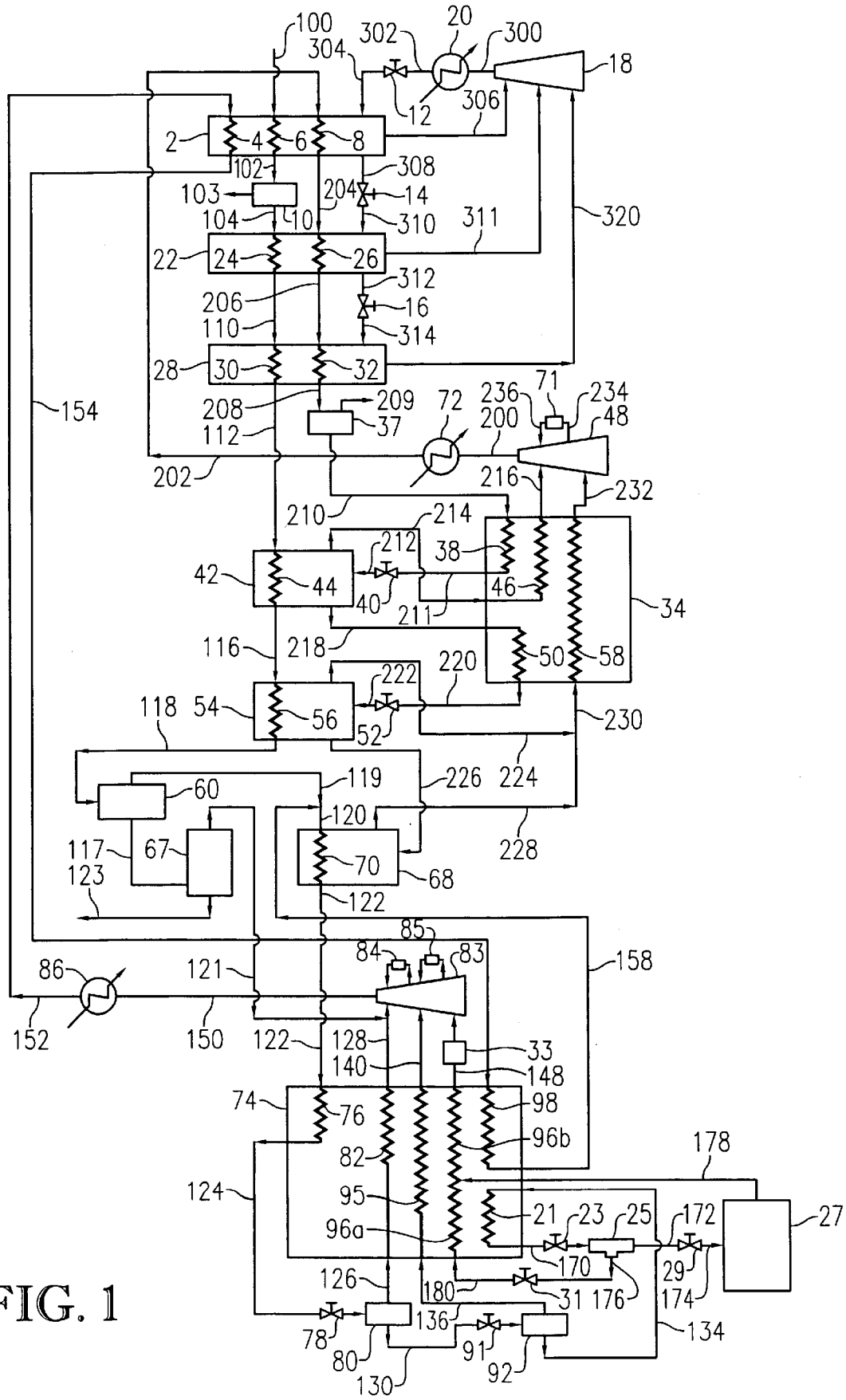

This invention concerns a method and an apparatus for liquefying natural gas. In another aspect, the invention concerns an improved multi-stage expansion cycle for reducing the pressure of a cooled and pressurized liquefied natural gas (LNG) stream to near atmospheric pressure.

2. Description of the Prior Art

The cryogenic liquefaction of natural gas is routinely practiced as a means of converting natural gas into a more convenient form for transportation and storage. Such liquefaction reduces the volume by about 600-fold and results in a product which can be stored and transported at near atmospheric pressure.

With regard to ease of storage, natural gas is frequently transported by pipeline from the source of supply to a distant market. It is desirable to operate the pipeline under a substantially constant and high load factor but often the deliverability or capacity of the pipeline will exceed demand while at other times the demand may exceed the deliverability of the pipeline. In order to shave off the peaks where demand exceeds supply or the valleys when supply exceeds demand, it is desirable to store the excess gas in such a manner that it can be delivered when the supply exceeds demand. Such practice allows future demand peaks to be met with material from storage. One practical means for doing this is to convert the gas to a liquefied state for storage and to then vaporize the liquid as demand requires.

The liquefaction of natural gas is of even greater importance when transporting gas from a supply source which is separated by great distances from the candidate market and a pipeline either is not available or is impractical. This is particularly true where transport must be made by ocean-going vessels. Ship transportation in the gaseous state is generally not practical because appreciable pressurization is required to significantly reduce the specific volume of the gas. Such pressurization requires the use of more expensive storage containers.

In order to store and transport natural gas in the liquid state, the natural gas is preferably cooled to −240° F. to −260° F. where the liquefied natural gas (LNG) possesses a near-atmospheric vapor pressure. Numerous systems exist in the prior art for the liquefaction of natural gas in which the gas is liquefied by sequentially passing the gas at an elevated pressure through a plurality of cooling stages whereupon the gas is cooled to successively lower temperatures until the liquefaction temperature is reached. Cooling is generally accomplished by heat exchange with one or more refrigerants such as propane, propylene, ethane, ethylene, methane, nitrogen or combinations of the preceding refrigerants (e.g., mixed refrigerant systems). A liquefaction methodology which is particularly applicable to the current invention employs an open methane cycle for the final refrigeration cycle wherein a pressurized LNG-bearing stream is flashed and the flash vapors (i.e., the flash gas stream(s)) are subsequently employed as cooling agents, recompressed, cooled, combined with the processed natural gas feed stream and liquefied thereby producing the pressurized LNG-bearing stream.

Typically, LNG plants that employ an open methane cycle for the final refrigeration cycle utilize three expansion (i.e., flash) stages, with each expansion stage including flashing of the LNG-bearing stream in an expander followed by separation of the flash gas stream and LNG-bearing stream in a gas-liquid phase separator. In a conventional open methane cycle, the final flash stage includes reducing the pressure of the LNG-bearing stream to about atmospheric pressure in a final-stage expander and then separating the low pressure flash gas stream from the low pressure LNG-bearing stream in a final-stage gas-liquid separator. From the final-stage separator, a cryogenic pump is used to pump the low pressure LNG-bearing stream to the LNG storage tank(s).

As in all processing plants, it is desirable for LNG plants to minimize capital expense and operating expense by reducing the amount of equipment and controls necessary to operate the plant. Thus, it would be a significant contribution to the art and to the economy if there existed an open methane cycle that eliminated at least some of the equipment and/or controls associated with the multi-stage expansion cycle.

OBJECTS AND SUMMARY OF THE INVENTION

It is an object of the present invention to provide a novel natural gas liquefaction system that employs an open methane cycle and requires a reduced amount of equipment.

Another object of the invention is to provide an open methane cycle that does not require cryogenic pumps to transport the LNG-bearing stream from the final-stage gas-liquid separation vessel to the LNG storage tank.

A further object of the invention is to provide an open methane cycle that utilizes only two separation vessels rather than the conventional three separation vessels.

It should be understood that the above objects are exemplary and need not all be accomplished by the invention claimed herein. Other objects and advantages of the invention will be apparent from the written description and drawings.

Accordingly, in one embodiment of the present invention there is provided a process for liquefying natural gas comprising the steps of: (a) flashing a pressurized liquefied natural gas stream in a first expander to provide a first flash gas and a first liquid stream; (b) flashing at least a portion of the first liquefied stream in a second expander to provide a second flash gas and a second liquid stream; and (c) flashing at least a portion of the second liquid stream at or immediately upstream of a liquefied natural gas storage tank, thereby providing a third flash gas and a final liquefied natural gas product.

In another embodiment of the present invention, there is provided a process for liquefying natural gas comprising the steps of: (a) flashing a pressurized liquefied natural gas stream in a first expander to provide a first flash gas and a first liquid stream; (b) flashing at least a portion of the first liquid stream in a second expander to provide a second flash gas and a second liquid stream; (c) subcooling at least a portion of the second liquid stream in a heat exchanger, thereby providing a subcooled liquefied natural gas stream; and (d) conducting at least a portion of the subcooled liquefied natural gas stream to a liquefied natural gas storage tank.

In a further embodiment of the present invention, there is provided a process for liquefying natural gas comprising the steps of: (a) flashing a first liquefied natural gas stream in a first expander to provide a first flash gas and a first liquid stream; (b) conducting a product portion of the first liquid stream to a liquefied natural gas storage tank; (c) conducting a refrigerant portion of the first liquid stream to a heat exchanger; (d) conducting natural gas vapors from the liquefied natural gas storage tank to the heat exchanger; and (e) combining the natural gas vapors and the refrigerant portion in the heat exchanger.

In still another embodiment of the present invention, there is provided an apparatus for liquefying natural gas. The apparatus comprises a first liquid expander, a first gas-liquid separator, a second liquid expander, a second gas-liquid separator, an indirect heat exchanger, a splitter, and a liquefied natural gas storage tank. The first gas-liquid separator is fluidly coupled to an outlet of the first expander. The second liquid expander is fluidly coupled to a liquid outlet of the first gas-liquid separator. The second gas-liquid separator is fluidly coupled to an outlet of the second expander. The indirect heat exchanger defines a first fluid flow path and a second fluid flow path that are isolated from one another. The first flow path inlet is fluidly coupled to the second liquid outlet. The splitter is fluidly coupled to an outlet of the first flow path. The liquefied natural gas storage tank has an inlet that is fluidly coupled to a product outlet of the splitter.

BRIEF DESCRIPTION OF THE DRAWING FIGURES

Figure 2:
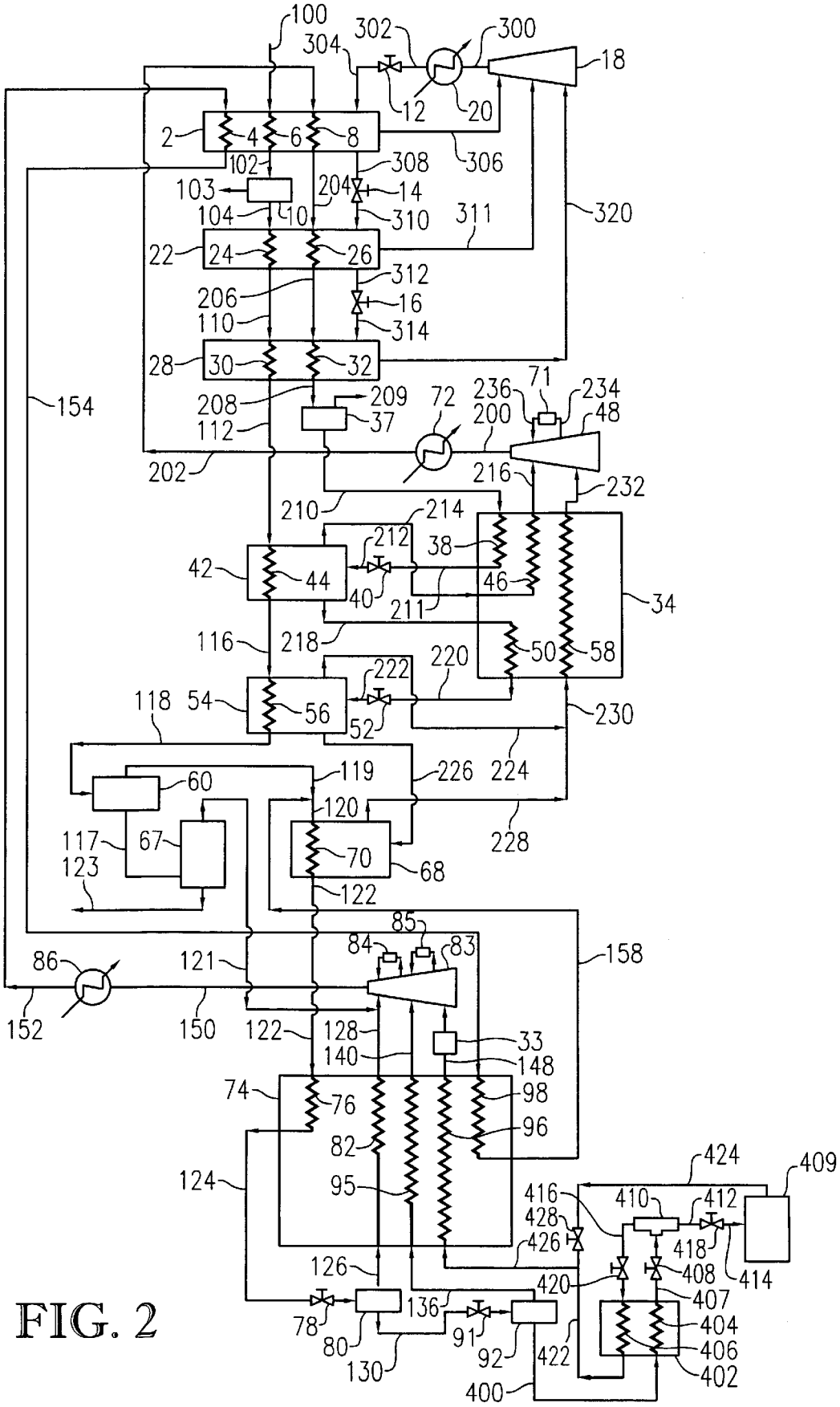

A preferred embodiment of the present invention is described in detail below with reference to the attached drawing figures, wherein:

FIG. 1 is a simplified flow diagram of a cascaded refrigeration process for LNG production which employs a novel open methane refrigeration cycle; and FIG. 2 is a simplified flow diagram of a cascade refrigeration process which employs an alternative embodiment of the novel open methane refrigeration cycle.

DETAILED DESCRIPTION OF THE PREFERRED EMBODIMENT

As used herein, the term open-cycle cascaded refrigeration process refers to a cascaded refrigeration process comprising at least one closed refrigeration cycle and one open refrigeration cycle where the boiling point of the refrigerant/cooling agent employed in the open cycle is less than the boiling point of the refrigerating agent or agents employed in the closed cycle(s) and a portion of the cooling duty to condense the compressed open-cycle refrigerant/cooling agent is provided by one or more of the closed cycles. In the current invention, methane or a predominately methane stream is employed as the refrigerant/cooling agent in the open cycle. This stream is comprised of the processed natural gas feed stream and the compressed open methane cycle gas streams.

The design of a cascaded refrigeration process involves a balancing of thermodynamic efficiencies and capital costs. In heat transfer processes, thermodynamic irreversibilities are reduced as the temperature gradients between heating and cooling fluids become smaller, but obtaining such small temperature gradients generally requires significant increases in the amount of heat transfer area, major modifications to various process equipment and the proper selection of flowrates through such equipment so as to ensure that both flowrates and approach and outlet temperatures are compatible with the required heating/cooling duty.

One of the most efficient and effective means of liquefying natural gas is via an optimized cascade-type operation in combination with expansion-type cooling. Such a liquefaction process is comprised of the sequential cooling of a natural gas stream at an elevated pressure, for example about 625 psia, by sequentially cooling the gas stream by passage through a multistage propane cycle, a multistage ethane or ethylene cycle, and an open-end methane cycle which utilizes a portion of the feed gas as a source of methane and which includes therein a multistage expansion cycle to further cool the same and reduce the pressure to near-atmospheric pressure. In the sequence of cooling cycles, the refrigerant having the highest boiling point is utilized first followed by a refrigerant having an intermediate boiling point and finally by a refrigerant having the lowest boiling point. As used herein, the terms "upstream" and "downstream" shall be used to describe the relative positions of various components of a natural gas liquefaction plant along the flow path of natural gas through the plant.

Various pretreatment steps provide a means for removing undesirable components, such as acid-gases, mercaptan, mercury, and moisture from the natural gas feed stream delivered to the facility. The composition of this gas stream may vary significantly. As used herein, a natural gas stream is any stream principally comprised of methane which originates in major portion from a natural gas feed stream, such feed stream for example containing at least 85 percent methane by volume, with the balance being ethane, higher hydrocarbons, nitrogen, carbon dioxide and a minor amounts of other contaminants such as mercury, hydrogen sulfide, and mercaptan. The pretreatment steps may be separate steps located either upstream of the cooling cycles or located downstream of one of the early stages of cooling in the initial cycle. The following is a non-inclusive listing of some of the available means which are readily available to one skilled in the art. Acid gases and to a lesser extent mercaptan are routinely removed via a sorption process employing an aqueous amine-bearing solution. This treatment step is generally performed upstream of the cooling stages in the initial cycle. A major portion of the water is routinely removed as a liquid via two-phase gas-liquid separation following gas compression and cooling upstream of the initial cooling cycle and also downstream of the first cooling stage in the initial cooling cycle. Mercury is routinely removed via mercury sorbent beds. Residual amounts of water and acid gases are routinely removed via the use of properly selected sorbent beds such as regenerable molecular sieves.

The pretreated natural gas feed stream is generally delivered to the liquefaction process at an elevated pressure or is compressed to an elevated pressure, that being a pressure greater than 500 psia, preferably about 500 psia to about 900 psia, still more preferably about 500 psia to about 675 psia, still yet more preferably about 600 psia to about 675 psia, and most preferably about 625 psia. The stream temperature is typically near ambient to slightly above ambient. A representative temperature range being 60° F. to 138° F.

As previously noted, the natural gas feed stream is cooled in a plurality of multistage (for example, three) cycles or steps by indirect heat exchange with a plurality of refrigerants, preferably three. The overall cooling efficiency for a given cycle improves as the number of stages increases but this increase in efficiency is accompanied by corresponding increases in net capital cost and process complexity. The feed gas is preferably passed through an effective number of refrigeration stages, nominally two, preferably two to four, and more preferably three stages, in the first closed refrigeration cycle utilizing a relatively high boiling refrigerant. Such refrigerant is preferably comprised in major portion of propane, propylene or mixtures thereof, more preferably the refrigerant comprises at least about 75 mole percent propane, even more preferably at least 90 mole percent propane, and most preferably the refrigerant consists essentially of propane. Thereafter, the processed feed gas flows through an effective number of stages, nominally two, preferably two to four, and more preferably two or three, in a second closed refrigeration cycle in heat exchange with a refrigerant having a lower boiling point. Such refrigerant is preferably comprised in major portion of ethane, ethylene or mixtures thereof, more preferably the refrigerant comprises at least about 75 mole percent ethylene, even more preferably at least 90 mole percent ethylene, and most preferably the refrigerant consists essentially of ethylene. Each cooling stage comprises a separate cooling zone. As previously noted, the processed natural gas feed stream is combined with one or more recycle streams (i.e., compressed open methane cycle gas streams) at various locations in the second cycle thereby producing a liquefaction stream. In the last stage of the second cooling cycle, the liquefaction stream is condensed (i.e., liquefied) in major portion, preferably in its entirety thereby producing a pressurized LNG-bearing stream. Generally, the process pressure at this location is only slightly lower than the pressure of the pretreated feed gas to the first stage of the first cycle.

Generally, the natural gas feed stream will contain such quantities of $C_2$+ components so as to result in the formation of a $C_2$+ rich liquid in one or more of the cooling stages. This liquid is removed via gas-liquid separation means, preferably one or more conventional gas-liquid separators. Generally, the sequential cooling of the natural gas in each stage is controlled so as to remove as much as possible of the $C_2$ and higher molecular weight hydrocarbons from the gas to produce a gas stream predominating in methane and a liquid stream containing significant amounts of ethane and heavier components. An effective number of gas/liquid separation means are located at strategic locations downstream of the cooling zones for the removal of liquids streams rich in $C_2$+ components. The exact locations and number of gas/liquid separation means, preferably conventional gas/liquid separators, will be dependant on a number of operating parameters, such as the $C_2$+ composition of the natural gas feed stream, the desired BTU content of the LNG product, the value of the $C_2$+ components for other applications and other factors routinely considered by those skilled in the art of LNG plant and gas plant operation. The $C_2$+ hydrocarbon stream or streams may be demethanized via a single stage flash or a fractionation column. In the latter case, the resulting methane-rich stream can be directly returned at pressure to the liquefaction process. In the former case, this methane-rich stream can be repressurized and recycle or can be used as fuel gas. The $C_2$+ hydrocarbon stream or streams or the demethanized $C_2$+ hydrocarbon stream may be used as fuel or may be further processed such as by fractionation in one or more fractionation zones to produce individual streams rich in specific chemical constituents (ex., $C_2$, $C_3$, $C_4$ and $C_5$+).

The pressurized LNG-bearing stream is then further cooled in a third cycle or step referred to as the open methane cycle via contact in a main methane economizer with flash gases (i.e., flash gas streams) generated in this third cycle in a manner to be described later and via expansion of the pressurized LNG-bearing stream to near atmospheric pressure. The flash gasses used as a refrigerant in the third refrigeration cycle are preferably comprised in major portion of methane, more preferably the flash gas refrigerant comprises at least 75 mole percent methane, still more preferably at least 90 mole percent methane, and most preferably the refrigerant consists essentially of methane. During expansion of the pressurized LNG-bearing stream to near atmospheric pressure, the pressurized LNG-bearing stream is cooled via at least one, preferably two to four, and more preferably three expansions where each expansion employs as a pressure reduction means either Joule-Thomson expansion valves or hydraulic expanders. The expansion is followed by a separation of the gas-liquid product with a separator. When a hydraulic expander is employed and properly operated, the greater efficiencies associated with the recovery of power, a greater reduction in stream temperature, and the production of less vapor during the flash step will frequently more than off-set the more expensive capital and operating costs associated with the expander. In one embodiment, additional cooling of the pressurized LNG-bearing stream prior to flashing is made possible by first flashing a portion of this stream via one or more hydraulic expanders and then via indirect heat exchange means employing said flash gas stream to cool the remaining portion of the pressurized LNG-bearing stream prior to flashing. The warmed flash gas stream is then recycled via return to an appropriate location, based on temperature and pressure considerations, in the open methane cycle and will be recompressed.

A cascaded process uses one or more refrigerants for transferring heat energy from the natural gas stream to the refrigerant and ultimately transferring said heat energy to the environment. In essence, the overall refrigeration system functions as a heat pump by removing heat energy from the natural gas stream as the stream is progressively cooled to lower and lower temperatures.

The liquefaction process may use one of several types of cooling which include but is not limited to (a) indirect heat exchange, (b) vaporization, and (c) expansion or pressure reduction. Indirect heat exchange, as used herein, refers to a process wherein the refrigerant cools the substance to be cooled without actual physical contact between the refrigerating agent and the substance to be cooled. Specific examples of indirect heat exchange means include heat exchange undergone in a shell-and-tube heat exchanger, a core-in-kettle heat exchanger, and a brazed aluminum plate-fin heat exchanger. The physical state of the refrigerant and substance to be cooled can vary depending on the demands of the system and the type of heat exchanger chosen. Thus, a shell-and-tube heat exchanger will typically be utilized where the refrigerating agent is in a liquid state and the substance to be cooled is in a liquid or gaseous state or when one of the substances undergoes a phase change and process conditions do not favor the use of a core-in-kettle heat exchanger. As an example, aluminum and aluminum alloys are preferred materials of construction for the core but such materials may not be suitable for use at the designated process conditions. A plate-fin heat exchanger will typically be utilized where the refrigerant is in a gaseous state and the substance to be cooled is in a liquid or gaseous state. Finally, the core-in-kettle heat exchanger will typically be utilized where the substance to be cooled is liquid or gas and the refrigerant undergoes a phase change from a liquid state to a gaseous state during the heat exchange.

Vaporization cooling refers to the cooling of a substance by the evaporation or vaporization of a portion of the substance with the system maintained at a constant pressure. Thus, during the vaporization, the portion of the substance which evaporates absorbs heat from the portion of the substance which remains in a liquid state and hence, cools the liquid portion.

Finally, expansion or pressure reduction cooling refers to cooling which occurs when the pressure of a gas, liquid or a two-phase system is decreased by passing through a pressure reduction means. In one embodiment, this expansion means is a Joule-Thomson expansion valve. In another embodiment, the expansion means is either a hydraulic or gas expander. Because expanders recover work energy from the expansion process, lower process stream temperatures are possible upon expansion.

The flow schematic and apparatus set forth in FIG. 1 is a first embodiment of the inventive open-cycle cascaded liquefaction process. FIG. 2 is a second embodiment of the inventive open-cycle cascade liquefaction process. Those skilled in the art will recognized that FIGS. 1 and 2 are schematics only and, therefore, many items of equipment that would be needed in a commercial plant for successful operation have been omitted for the sake of clarity. Such items might include, for example, compressor controls, flow and level measurements and corresponding controllers, temperature and pressure controls, pumps, motors, filters, additional heat exchangers, and valves, etc. These items would be provided in accordance with standard engineering practice.

To facilitate an understanding of FIGS. 1 and 2, the following numbering nomenclature was employed. Items numbered 1 through 99 are process vessels and equipment which are directly associated with the liquefaction process. Items numbered 100 through 199 correspond to flow lines or conduits which contain primarily methane. Items numbered 200 through 299 correspond to flow lines or conduits which contain the refrigerant ethylene. Items numbered 300 through 399 correspond to flow lines or conduits which contain the refrigerant propane. In FIG. 2, items numbered 400 through 499 are vessels, equipment, lines, or conduits of the open methane cycle whose configuration is different than the configuration shown in FIG. 1.

Referring to FIG. 1, pretreated natural gas is introduced to the liquefaction system through conduit 110. Gaseous propane is compressed in multistage compressor 18 driven by a gas turbine driver which is not illustrated. The three stages preferably form a single unit although they may be separate units mechanically coupled together to be driven by a single driver. Upon compression, the compressed propane is passed through conduit 300 to cooler 20 where it is liquefied. A representative pressure and temperature of the liquefied propane refrigerant prior to flashing is about 116° F. and about 190 psia. Although not illustrated in FIG. 1, it is preferable that a separation vessel be located downstream of cooler 20 and upstream of expansion valve 12 for the removal of residual light components from the liquefied propane. Such vessels maybe comprised of a single-stage gas liquid separator or may be more sophisticated and comprised of an accumulator section, a condenser section and an absorber section, the latter two of which may be continuously operated or periodically brought on-line for removing residual light components from the propane. The stream from this vessel or the stream from cooler 20, as the case may be, is pass through conduit 302 to a pressure reduction means such as a expansion valve 12 wherein the pressure of the liquefied propane is reduced thereby evaporating or flashing a portion thereof. The resulting two-phase product then flows through conduit 304 into high-stage propane chiller 2 for indirect heat exchange with gaseous methane refrigerant introduced via conduit 152, natural gas feed introduced via conduit 100, and gaseous ethylene refrigerant introduced via conduit 202 via indirect heat exchange means 4, 6 and 8, thereby producing cooled gas streams respectively transported via conduits 154, 102 and 204.

The flashed propane gas from high-stage propane chiller 2 is returned to compressor 18 through conduit 306. This gas is fed to the high stage inlet port of compressor 18. The remaining liquid propane is passed through conduit 308, the pressure further reduced by passage through a pressure reduction means, illustrated as expansion valve 14, whereupon an additional portion of the liquefied propane is flashed. The resulting two-phase stream is then fed to an intermediate-stage propane chiller 22 through conduit 310 thereby providing a coolant for chiller 22.

The cooled natural gas feed stream from chiller 2 flows via conduit 102 to a knock-out vessel 10 wherein gas and liquid phases are separated. The liquid phase which is rich in C3+ components is removed via conduit 103. The gaseous phase is removed via conduit 104 and conveyed to propane chiller 22. Ethylene refrigerant is introduced to chiller 22 via conduit 204. In chiller 22, the processed natural gas stream and an ethylene refrigerant stream are respectively cooled via indirect heat exchange means 24 and 26 thereby producing a cooled processed natural gas stream and an ethylene refrigerant stream via conduits 110 and 206. The thus evaporated portion of the propane refrigerant is separated and passed through conduit 311 to the intermediate-stage inlet of compressor 18. Liquid propane is passed through conduit 312, the pressure further reduced by passage through a pressure reduction means, illustrated as expansion valve 16, whereupon an additional portion of liquefied propane is flashed. The resulting two-phase stream is then fed to chiller 28 through conduit 314 thereby providing coolant to low-stage propane chiller 28.

As illustrated in FIG. 1, the cooled processed natural gas stream flows from intermediate-stage propane chiller 22 to low-stage propane chiller/condenser 28 via conduit 110. In chiller 28, the stream is cooled via indirect heat exchange means 30. In a like manner, the ethylene refrigerant stream flows from intermnediate-stage propane chiller 22 to low-stage propane chiller/condenser 28 via conduit 206. In the latter, the ethylene-refrigerant is condensed via an indirect heat exchange means 32 in nearly its entirety. The vaporized propane is removed from low-stage propane chiller/condenser 28 and returned to the low-stage inlet of compressor 18 via conduit 320. Although FIG. 1 illustrates cooling of streams provided by conduits 110 and 206 to occur in the same vessel, the chilling of stream 110 and the cooling and condensing of stream 206 may respectively take place in separate process vessels (ex., a separate chiller and a separate condenser, respectively).

As illustrated in FIG. 1, the processed natural gas stream exiting low-stage propane chiller 28 via conduit 112 is then introduced to a high-stage ethylene chiller 42. Ethylene refrigerant exits the low-stage propane chiller 28 via conduit 208 and is fed to a separation vessel 37 wherein light components are removed via conduit 209 and condensed ethylene is removed via conduit 210. The separation vessel is analogous to the earlier discussed for the removal of light components from liquefied propane refrigerant and may be a single-stage gas/liquid separator or may be a multiple stage operation resulting in a greater selectivity of the light components removed from the system. The ethylene refrigerant at this location in the process is generally at a temperature of about −24° F. and a pressure of about 285 psia. The ethylene refrigerant, via conduit 210, then flows to a main ethylene economizer 34 wherein it is cooled via indirect heat exchange means 38 and removed via conduit 211 and passed to a pressure reduction means such as an expansion valve 40 whereupon the refrigerant is flashed to a preselected temperature and pressure and fed to high-stage ethylene chiller 42 via conduit 212. Vapor is removed from chiller 42 via conduit 214 and routed to the main ethylene-economizer 34 wherein the vapor functions as a coolant via indirect heat exchange means 46. The ethylene vapor is then removed from ethylene economizer 34 via conduit 216 and feed to the high-stage inlet on the ethylene compressor 48. The ethylene refrigerant which is not vaporized in the high-stage ethylene chiller 42 is removed via conduit 218 and returned to the ethylene main economizer 34 for further cooling via indirect heat exchange means 50, removed from main ethylene economizer 34 via conduit 220 and flashed in a pressure reduction means illustrated as expansion valve 52 whereupon the resulting two-phase product is introduced into a low-stage ethylene chiller 54 via conduit 222. The liquefaction stream is removed from high-stage ethylene chiller 42 via conduit 116 and directly fed to low-stage ethylene chiller 54 wherein it undergoes additional cooling and partial condensation via indirect heat exchange means 56. The resulting two-phase stream then flows via conduit 118 to a two phase separator 60 from which is produced a methane-rich vapor stream via conduit 119 and, via conduit 117, a. liquid stream rich in $C_2$+ components which is subsequently flashed or fractionated in vessel 67 thereby producing via conduit 123 a heavies stream and a second methane-rich stream which is transferred via conduit 121 and after combination with a second stream via conduit 128 is fed to the high pressure inlet port of a methane compressor 83.

The stream in conduit 119 and a cooled compressed open methane cycle gas stream provided via conduit 158 are combined and fed via conduit 120 to low-stage ethylene condenser 68 wherein this stream exchanges heat via indirect heat exchange means 70 with the liquid effluent from low-stage ethylene chiller 54 which is routed to low-stage ethylene condenser 68 via conduit 226. In condenser 68, the combined streams are condensed and produced from condenser 68 via conduit 122 is a pressurized LNG-bearing stream. The vapor from low-stage ethylene chiller 54, via conduit 224, and low-stage ethylene condenser 68, via conduit 228, are combined and routed, via conduit 230, to main ethylene economizer 34 wherein the vapors function as a coolant via indirect heat exchange means 58. The stream is then routed via conduit 232 from main ethylene economizer 34 to the low-stage side of ethylene compressor 48. As noted in FIG. 1, the compressor effluent from vapor introduced via the low-stage side is removed via conduit 234, cooled via inter-stage cooler 71 and returned to compressor 48 via conduit 236 for injection with the high-stage stream present in conduit 216. Preferably, the two-stages are a single module although they may each be a separate module and the modules mechanically coupled to a common driver. The compressed ethylene product from compressor 48 is routed to a downstream cooler 72 via conduit 200. The product from cooler 72 flows via conduit 202 and is introduced, as previously discussed, to high-stage propane chiller 2.

The pressurized LNG-bearing stream, preferably a liquid stream in its entirety, in conduit 122 is generally at a temperature of about −135° F. and about 580 psia. This stream passes via conduit 122 through a main methane economizer 74 wherein the stream is further cooled by indirect heat exchange means 76 as hereinafter explained. From main methane economizer 74 the pressurized LNG-bearing stream passes through conduit 124 and its pressure is reduced by a pressure reductions means which is illustrated as expansion valve 78, which evaporates or flashes a portion of the gas stream thereby generating a flash gas stream. Preferably, expansion valve 78 is operable to reduce the pressure of the LNG-bearing stream by about 40 to about 90 percent, more preferably 55 to 75 percent (e.g., if the pressure is reduced from 600 psia to 200 psia it is reduced by 66.7 percent). The flashed stream from expansion valve 78 is then passed to methane high-stage flash drum 80 where it is separated into a flash gas stream discharged through conduit 126 and a liquid phase stream (i.e., pressurized LNG-bearing stream) discharged through conduit 130. The flash gas stream is then transferred to main methane economizer 74 via conduit 126 wherein the stream functions as a coolant via indirect heat exchange means 82. The flash gas stream (i.e., warmed flash gas stream) exits the main methane economizer via conduit 128 where it is combined with a gas stream delivered by conduit 121. These streams are then fed to the high pressure inlet of methane compressor 83. The liquid phase in conduit 130 is expanded or flashed via pressure reduction means, illustrated as expansion valve 91, to further reduce the pressure and at the same time, evaporate a second portion thereof. Preferably, expansion valve 91 is operable to reduce the pressure of the LNG-bearing stream by about 40 to about 90 percent, more preferably 60 to 80 percent. This flash gas stream is then passed to low-stage methane flash drum 92 where the stream is separated into a flash gas stream passing through conduit 135 and a liquid phase stream passing through conduit 134. The flash gas stream flows through conduit 136 to indirect heat exchange means 95 in main methane economizer 74. The warmed flash gas stream leaves main methane economizer 74 via conduit 140 which is connected to the intermediate stage inlet of methane compressor 83. The liquid phase exiting low-stage flash drum 92 via conduit 134 is passed to methane economizer 74 wherein it is subcooled via indirect heat exchange means 21 with a downstream cooling agent to be described in detail below. As used herein, the term "subcooled" shall denote a procedure for further cooling an already liquefied stream below its boiling point temperature. After subcooling in heat exchange means 21, the subcooled LNG-bearing stream exits methane economizer 74 and is passed to a pressure reduction means, illustrated as expansion valve 23, via conduit 170. After pressure reduction in expansion vale 23, the reduced pressure LNG-bearing stream is conducted to a splitter 25 wherein the stream is split into a product stream for transport to a LNG storage tank 27 via conduits 172 and 174 and a refrigerant stream for transport back to methane economizer 74 via conduits 176 and 180. A back pressure/expansion valve 29 is fluidly disposed between conduits 172 and 174 and is positioned proximate and immediately upstream of LNG storage tank. As used herein, the term "immediately upstream of" shall denote the position of an upstream component relative to a downstream component wherein no substantial processing (e.g., gas-liquid separation, expansion, or compression) of the flow stream takes place between the upstream and downstream components. Back pressure/expansion valve 29 is operable to maintain sufficient pressure in conduit 172 so that the LNG-bearing stream in conduit 172 is maintained in a substantially liquid form. It is important to avoid two-phase flow in conduit 172 because the presence of vapor in conduit 172 can require a larger diameter conduit to carry the same quantity of LNG. Further, the presence of vapor in conduit 172 can cause a condition known as "slug flow." Such slug flow can exert undesirably high physical surge forces on the conduit which could ultimately cause damage to the conduit. Preferably, back pressure/expansion valve 29 is operable to reduce the pressure of the LNG-bearing stream by about 30 to about 80 percent, more preferably 40 to 60 percent.

Although not illustrated in FIG. 1, conduit 172 is typically longer than most other conduits in FIG. 1. In many LNG plants, the LNG storage tank is located several hundred feet from the main components of the LNG plant. This is especially true when the LNG storage tank is positioned on an ocean-going vessel that is docked in a harbor, while the main components of the LNG plant are positioned on land adjacent the harbor. Thus, conduit 172 typically has a length of more than about 20 feet, more typically more than about 50 feet, and most typically more than 100 feet. It is preferred for the distance between back pressure/expansion valve 29 and LNG storage tank to be minimized because two-phase flow will exist in conduit 174 due to flashing of the LNG-bearing stream at valve 29. Thus, it is preferred for the length of conduit 174 to be less than 50 feet, more preferably less than 20 feet, and most preferably less than 10 feet. After pressure reduction in valve 29, the LNG-bearing stream is conducted to LNG storage tank 27. In LNG storage tank 27, vapors "boil off" of the LNG, and the resulting boil off vapors are then removed from LNG storage tank 27 via conduit 178.

The refrigerant portion of the subcooled LNG-bearing stream flowing out of splitter 25 through conduit 176 is preferably subjected to pressure reduction in a pressure reduction means, illustrated as expansion valve 31. The resulting cooled, pressure-reduced stream is then conducted to methane economizer 74 via conduit 180 for indirect heat exchange in heat exchange means 96. It is preferred for the first portion 96*a* of indirect heat exchange means 96 and indirect heat exchange means 21 to form two sides (i.e., a cold side and a hot side) of a common indirect heat exchanger so that the cooled pressure-reduced stream in first portion 96*a* can be used to subcool the LNG-bearing stream in heat exchange means 21. After the stream in first portion 96*a* of heat exchange means 96 is used to cool the stream in heat exchange means 21, boil off vapors from conduit 178 can be combined with the stream from first portion 96*a* and the resulting combined stream can be used in second portion 96*b* of heat exchange means 96 to cool the stream in heat transfer means 98, described in detail below. Because the temperature of the boil off vapors in conduit 178 is greater than the temperature of the stream entering first portion 96*a* of heat exchange means 96 via conduit 180, it is preferred for the boil off vapor stream to be introduced into heat exchange means 96 after the stream in first portion 96*a* has been used to subcool the stream in heat exchange means 21. The combined stream from second portion 96*b* can then be conducted via conduit 148 to a suction drum 33 for removal of any liquids present in the stream. From suction drum 33, the vapor stream is conducted to the low-stage inlet of compressor 83.

As shown in FIG. 1, the high, intermediate and low stages of compressor 83 are preferably combined as single unit. However, each stage may exist as a separate unit where the units are mechanically coupled together to be driven by a single driver. The compressed gas from the low-stage section passes through an inter-stage cooler 85 and is combined with the intermediate pressure gas in conduit 140 prior to the second-stage of compression. The compressed gas from the intermediate stage of compressor 83 is passed through an inter-stage cooler 84 and is combined with the high pressure gas provided via conduits 120 and 121 prior to the third-stage of compression. The compressed gas (i.e., compressed open methane cycle gas stream) is discharged from high stage methane compressor through conduit 150, is cooled in cooler 86 and is routed to the high pressure propane chiller 2 via conduit 152 as previously discussed. The stream is cooled in chiller 2 via indirect heat exchange means 4 and flows to main methane economizer 74 via conduit 154. The compressed open methane cycle gas stream from chiller 2 which enters the main methane economizer 74 undergoes cooling in its entirety via flow through indirect heat exchange means 98. This cooled stream is then removed via conduit 158 and combined with the processed natural gas feed stream upstream of the first stage (i.e., high pressure) of ethylene cooling.

FIG. 2 illustrates an alternative embodiment of the present invention that provides many of the same advantages as the system shown in FIG. 1. The bulk of the components illustrated in FIG. 2 are the same as those illustrated in FIG. 1 and have the same numerical identification. The components that are different in FIG. 2 than in FIG. 1 are numbered 400–499. The main difference between FIG. 1 and FIG. 2 is the configuration of the open methane cycle, particularly the final flash stage and subcooling of the LNG-bearing stream.

FIG. 2 illustrates that the LNG-bearing stream exiting low-stage separator 92 via conduit 400 can be subcooled in a first heat transfer means 404 of a heat exchanger 402 by indirect heat exchange with a stream flowing through a second heat transfer means 406. After subcooling, the subcooled LNG-bearing stream is conducted via conduit 407 to an expansion valve 408 for pressure reduction. The resulting pressure-reduced subcooled stream is conducted to a splitter 410 where the stream is split into a product portion for transfer to a LNG storage tank 409 and a refrigerant portion for transfer to second heat transfer means 406 of heat exchanger 402. The product portion of the subcooled LNG-bearing stream is conducted to LNG storage tank 409 via conduits 412 and 414. A back pressure/expansion valve 418 is fluidly disposed between conduits 412 and 414 and immediately upstream of LNG storage tank 409. The refrigerant portion of the subcooled LNG-bearing stream is conducted to an expansion valve 420 for pressure reduction and cooling prior to being used in second heat transfer means 406 to subcool the stream in first heat transfer means 402. After use in heat exchanger 402, the stream from second heat transfer means 406 and boil off vapors from LNG storage tank 409 are routed to common conduit 426 via conduits 422 and 424 respectively. The combined stream is then conducted via conduit 426 to heat transfer means 96 for use as a refrigerant in cooling the stream in indirect heat exchange means 98.

Although the temperatures and pressures of the predominately methane stream in the open methane cycle described herein will vary depending on the composition of the natural gas and the specific operating parameters of the LNG plant, Table 1 gives preferred temperature and pressure ranges at certain locations in the open methane cycles illustrated in FIGS. 1 and 2.

TABLE 1

| CONDUIT OR VESSEL # FIG. 1/ FIG. 2 | TEMPERATURE RANGE (° F.) Preferred | TEMPERATURE RANGE (° F.) Most Preferred | PRESSURE RANGE (psia) Preferred | PRESSURE RANGE (psia) Most Preferred |
|---|---|---|---|---|
| 122/122 | −110 to −160 | −125 to −145 | 550–650 | 560–590 |
| 124/124 | −125 to −175 | −140 to −160 | 550–650 | 560–590 |
| 80/80 | −155 to −205 | −170 to −200 | 190–250 | 215–235 |
| 130/130 | −155 to −205 | −170 to −200 | 180–240 | 200–220 |
| 92/92 | −190 to −240 | −205 to −225 | 50–100 | 65–85 |

TABLE 1-continued

| CONDUIT OR VESSEL # FIG. 1/ FIG. 2 | TEMPERATURE RANGE (° F.) Preferred | Most Preferred | PRESSURE RANGE (psia) Preferred | Most Preferred |
|---|---|---|---|---|
| 134/300 | −190 to −240 | −205 to −225 | 40–80 | 55–65 |
| 170/305 | −210 to −260 | −235 to −255 | 40–80 | 55–65 |
| 172/312 | −220 to −270 | −235 to −255 | 25–75 | 40–55 |
| 174/314 | −225 to −275 | −240 to −260 | 10–50 | 25–35 |
| 27/309 | −225 to −275 | −240 to −260 | 10–50 | 25–35 |
| 178/324 | −210 to −260 | −235 to −245 | 10–50 | 25–35 |
| 176/316 | −220 to −270 | −235 to −255 | 25–75 | 40–55 |
| 180/326 | −240 to −290 | −255 to −275 | 2–20 | 5–10 |

The design of the open methane cycles illustrated in FIGS. 1 and 2 provides a number of advantages over prior art open methane cycles. For example, the final flashing of the LNG-bearing stream at or near the LNG storage tank allows for the elimination of at least one separation vessel used in a conventional open methane cycle. Further, such flashing of the LNG-bearing stream to near atmospheric pressure immediately upstream of the LNG storage tank maintains back pressure on the LNG-bearing stream up to the tank, thereby eliminating the need for conventional cryogenic pumps to transfer near atmospheric pressure LNG from a final separation vessel to the LNG storage tank. In accordance with conventional practice, the liquefied natural gas in the storage tank can be transported to a desired location (typically via an ocean-going LNG tanker). The LNG can then be vaporized at an onshore LNG terminal for transport in the gaseous state via conventional natural gas pipelines.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A process for liquefying natural gas, said process comprising the steps of:

(a) flashing a pressurized liquefied natural gas stream in a first expander to provide a first flash gas and a first liquid stream;

(b) flashing at least a portion of the first liquefied stream in a second expander to provide a second flash gas and a second liquid stream;

(c) flashing at least a portion of the second liquid stream at or immediately upstream of a liquefied natural gas storage tank, thereby providing a third flash gas and a final liquefied natural gas product; and (d) conducting the third flash gas and the final liquefied natural gas product to the liquefied natural gas storage tank.

2. A process according to claim 1; and (e) conducting at least a portion of the third flash gas from the liquefied natural gas storage tank to a heat exchanger for use as a cooling agent.

3. A process according to claim 2; and (f) conducting at least a portion of the third flash gas from the heat exchanger to a compressor; and (g) compressing at least a portion of the third flash gas in the compressor.

4. A process according to claim 1; and (h) upstream of the liquefied natural gas storage tank, splitting at least a portion of the second liquid stream into a refrigerant portion and a product portion.

5. A process according to claim 4; and (i) conducting the refrigerant portion and at least a portion of the third flash gas to a common conduit; and (j) combining the refrigerant portion and at least a portion of the third flash gas in the common conduit.

6. A process according to claim 5, said common conduit being a cold side of an indirect heat exchanger.

7. A process for liquefying natural gas, said process comprising the steps of:

(a) flashing a pressurized liquefied natural gas stream in a first expander to provide a first flash gas and a first liquid stream;

(b) flashing at least a portion of the first liquefied stream in a second expander to provide a second flash gas and a second liquid stream;

(c) flashing at least a portion of the second liquid stream at or immediately upstream of a liquefied natural gas storage tank, thereby providing a third flash gas and a final liquefied natural gas product;

(d) upstream of the liquefied natural gas storage tank, splitting at least a portion of the second liquid stream into a refrigerant portion and a product portion;

(e) conducting the refrigerant portion and at least a portion of the third flash gas to a common conduit;

(f) combining the refrigerant portion and at least a portion of the third flash gas in the common conduit, said common conduit being a cold side of an indirect heat exchanger; and (g) upstream of the liquefied natural gas storage tank, subcooling the second flash gas stream by indirect heat exchange in the heat exchanger.

8. A process according to claim 5; and (l) conducting the combined refrigerant portion and third flash gas from the common conduit to a compressor; and (m) compressing the combined refrigerant portion and third flash gas in the compressor.

9. A process according to claim 8; and (n) removing liquids from the combined refrigerant portion and third flash gas prior to compression in the compressor.

10. A process according to claim 1; and (o) upstream of the first expander, cooling the pressurized liquefied natural gas stream by indirect heat exchange with at least a portion of the first flash gas.

11. A process according to claim 10; and (p) upstream of the first expander, cooling the pressurized liquefied natural gas stream by indirect heat exchange with at least a portion of the second flash gas.

12. A process according to claim 1; and (q) conducting the second liquid stream from the second expander to the liquefied natural gas storage tank without the use of a pump fluidly disposed between the second expander and the liquefied natural gas storage tank.

13. A process according to claim 1, said flashing of step (a) including reducing the pressure of the pressurized liquefied natural gas stream by about 40 to about 90 percent, said flashing of step (b) including reducing the pressure of the first liquid stream by about 40 to about 90 percent, said flashing of step (c) including reducing the pressure of the second liquid stream by about 30 to about 80 percent.

14. A process according to claim 1, said pressurized natural gas stream entering the first expander at a pressure in the range of from about 550 psia to about 650 psia, said first liquid stream exiting the first expander at a pressure in the range of from about 180 psia to about 240 psia, said second liquid stream exiting the second expander at a pressure in the range of from about 40 psia to about 80 psia, said final liquefied natural gas product in the liquefied natural gas storage tank having a pressure in the range of from about 10 psia to about 50 psia.

15. A process according to claim 1; and (r) vaporizing liquefied natural gas produced via steps (a)–(d).

16. A process for liquefying natural gas, said process comprising the steps of:

(a) flashing a pressurized liquefied natural gas stream in a first expander to provide a first flash gas and a first liquid stream;

(b) flashing at least a portion of the first liquid stream in a second expander to provide a second flash gas and a second liquid stream;

(c) subcooling at least a portion of the second liquid stream in a heat exchanger, thereby providing a subcooled liquefied natural gas stream; and (d) conducting at least a portion of the subcooled liquefied natural gas stream to a liquefied natural gas storage tank.

17. A process according to claim 16; and (e) upstream of the liquefied natural gas storage tank and downstream of the heat exchanger, splitting at least a portion of the subcooled liquefied natural gas stream into a refrigerant portion and a product portion at a splitting point;

(f) conducting the refrigerant portion to the heat exchanger; and (g) conducting the product portion to the liquefied natural gas storage tank.

18. A process according to claim 17, said subcooling of step (d) being accomplished, at least in part, by indirect heat exchange between the refrigerant portion and the second liquid stream in the heat exchanger.

19. A process according to claim 17; and (h) immediately upstream of the liquefied natural gas storage tank, flashing at least a portion of the subcooled liquefied natural gas stream in a third expander, thereby providing a third flash gas and a final liquefied natural gas product in the liquefied natural gas storage tank.

20. A process according to claim 19; and (i) conducting at least a portion of the third flash gas from the liquefied natural gas storage tank to the heat exchanger; and (j) combining the refrigerant portion and the third flash gas in the heat exchanger.

21. A process according to claim 20; and (k) maintaining the product portion of the subcooled liquefied natural gas stream substantially in a liquid state using a back pressure valve disposed proximate an inlet of the liquefied natural gas storage tank.

22. A process according to claim 16; and (l) vaporizing liquefied natural gas produced via steps (a)–(d).

23. A process for liquefying natural gas, said process comprising the steps of:

(a) flashing a first liquefied natural gas stream in a first expander to provide a first flash gas and a first liquid stream;

(b) conducting a product portion of the first liquid stream to a liquefied natural gas storage tank, said product portion comprising both liquid and vapor;

(c) conducting a refrigerant portion of the first liquid stream to a heat exchanger;

(d) conducting natural gas vapors from the liquefied natural gas storage tank to the heat exchanger; and (e) combining the natural gas vapors and the refrigerant portion in the heat exchanger.

24. A process according to claim 23; and (f) subcooling the first liquid stream in the heat exchanger.

25. A process according to claim 24, said subcooling of step (f) being accomplished, at least in part, by indirect heat exchange between the refrigerant portion and the first liquid stream.

26. A process according to claim 25, said combining of step (e) being accomplished after the refrigerant portion has already been used in the heat exchanger to provide at least partial subcooling of the first liquid stream.

27. A process according to claim 24; and (g) downstream of the heat exchanger, splitting at least a portion of the first liquid stream into the product portion and the refrigerant portion at a splitting point; and (h) maintaining the product portion substantially in a liquid state using a back pressure valve disposed proximate an inlet of the liquefied natural gas storage tank.

28. A process according to claim 23; and (j) flashing the product portion in a third expander located immediately upstream of the liquefied natural gas storage tank, thereby forming said natural gas vapors.

29. A process according to claim 23; and (k) vaporizing liquefied natural gas produced via steps (a)–(d).

30. An apparatus for liquefying natural gas, said apparatus comprising:

a first liquid expander having a first expander outlet;

a first gas-liquid separator fluidly coupled to the first expander outlet and having a first gas outlet and a first liquid outlet;

a second liquid expander fluidly coupled to the first liquid outlet and having a second expander outlet;

a second gas-liquid separator fluidly coupled to the second expander outlet and having a second gas outlet and a second liquid outlet;

an indirect heat exchanger defining a first fluid flow path and a second fluid flow path, said first and second fluid flow paths being fluidly isolated from one another, said heat exchanger defining first and second flow path inlets and outlets for the first and second fluid flow paths respectively, said first flow path inlet being fluidly coupled to the second liquid outlet;

a splitter fluidly coupled to the first flow path outlet and having a product outlet and a refrigerant outlet; and a liquefied natural gas storage tank having a tank inlet fluidly coupled to the product outlet.

31. An apparatus according to claim 30, said refrigerant outlet being fluidly coupled to the second flow path inlet.

32. An apparatus according to claim 31; and a back pressure valve fluidly disposed between the product outlet of the splitter and the tank inlet and positioned proximate the tank inlet.

33. An apparatus according to claim 31; and a pressure reducer fluidly disposed between the first flow path outlet and the splitter.

34. An apparatus according to claim 30, said liquefied natural gas storage tank having a vapor outlet, said vapor outlet being fluidly coupled to the second flow path.

35. An apparatus according to claim 34, said heat exchanger having an intermediate second flow path inlet fluidly disposed downstream of the second flow path inlet, said vapor outlet being fluidly coupled to the intermediate second flow path inlet.

36. An apparatus according to claim 35, said intermediate second flow path inlet being fluidly disposed between the second flow path inlet and the second flow path outlet.

37. An apparatus according to claim 35, said first flow path being at least partly positioned adjacent an upstream portion of the second flow path for indirect heat exchange therebetween, said upstream portion of the second flow path being defined between the second flow path inlet and the intermediate second flow path inlet.

38. An apparatus according to claim 30; and a compressor having a compressor inlet fluidly coupled to the second flow path outlet.

39. An apparatus according to claim 38; and a liquids removal drum fluidly disposed between the second fluid outlet and the compressor inlet.

* * * * *

UNITED STATES PATENT AND TRADEMARK OFFICE

CERTIFICATE OF CORRECTION

PATENT NO. : 6,658,890 B1 
DATED : December 9, 2003
INVENTOR(S) : Paul R. Hahn, Jame Yao, Rong-Jwyn Lee and Ned P. Baudat It is certified that error appears in the above-identified patent and that said Letters Patent is hereby corrected as shown below:

Title page,
Item [75], Inventors, insert -- Phillip D. Ritchie, Bastrop, TX (US) --

Signed and Sealed this

Sixth Day of April, 2004

JON W. DUDAS
*Acting Director of the United States Patent and Trademark Office*